US009536417B1

(12) United States Patent
Rajala

(10) Patent No.: US 9,536,417 B1
(45) Date of Patent: Jan. 3, 2017

(54) METHOD AND SYSTEM FOR HIERARCHICAL MANAGEMENT OF PERSONAL EMERGENCY RESPONSE SYSTEM (PERS) DEVICES

(71) Applicant: Numerex Corp., Atlanta, GA (US)

(72) Inventor: Yoganand Rajala, Alpharetta, GA (US)

(73) Assignee: Numerex Corp., Atlanta, GA (US)

( * ) Notice: Subject to any disclaimer, the term of this patent is extended or adjusted under 35 U.S.C. 154(b) by 0 days.

(21) Appl. No.: 14/991,031

(22) Filed: Jan. 8, 2016

(51) Int. Cl.
*G08B 1/08* (2006.01)
*G08B 25/01* (2006.01)

(52) U.S. Cl.
CPC ..... *G08B 25/016* (2013.01)

(58) Field of Classification Search
CPC .. G05D 1/0274; G05D 1/0214; A61B 5/0022; A61B 5/746; A61B 5/1117; A61B 2505/01; A61B 5/0002; A61B 5/1112; A61B 5/1113; A61B 5/747; A61B 5/681; A61B 5/6824; A61B 5/6831; G08B 21/0453
USPC ..... 340/505, 531, 539, 573.11, 573.12,340/573.14; 455/404.2
See application file for complete search history.

(56) References Cited

U.S. PATENT DOCUMENTS

2015/0287296 A1* 10/2015 Hall et al. ..... G01S 5/0294 340/541
2015/0346963 A1* 12/2015 Spear ..... G06F 3/04842 715/733
2016/0094967 A1* 3/2016 Sulaiman et al. H04M 1/72541 455/404.2

* cited by examiner

*Primary Examiner* — Dhaval Patel
(74) *Attorney, Agent, or Firm* — King & Spalding LLP

(57) ABSTRACT

People at different levels of an organization can carry personal emergency response system (PERS) devices. A remote server can monitor the personal emergency response system devices, for example tracking device locations and monitoring for emergency alerts. The organization can include managers who are assigned level-specific responsibility. For example, a first manager may be responsible for a first portion of the organization, and a second manager may be responsible for a second portion of the organization. The managers may log into a website to monitor the people in their respective portions of the organization. The website can provide a manager with information that is specific to that manager's portion of the organization, as provided by the personal emergency response system devices.

29 Claims, 3 Drawing Sheets

METHOD AND SYSTEM FOR HIERARCHICAL MANAGEMENT OF PERSONAL EMERGENCY RESPONSE SYSTEM (PERS) DEVICES

TECHNICAL FIELD

The present disclosure relates generally to personal emergency response system (PERS) devices, through which a person can raise an emergency alert, and more particularly to hierarchical management of the devices based, for example, on a hierarchical organization.

BACKGROUND

Personal emergency response system devices generally provide a capability through which a person can raise an emergency alert when the person feels threatened, becomes injured, or otherwise experiences an emergency situation. The emergency alert can be transmitted wirelessly to elicit a response from a remote recipient. Personal emergency response system devices may be useful for monitoring the people who are carrying the devices, for example to track their locations.

However, need exists for improved technology for monitoring and managing personal emergency response system devices. For example, need exists for a capability to monitor, track, and/or locate groups of personal emergency response system devices. Further need exists to provide managers with information that is specific to the people they are managing. A capability addressing such a need, or some related deficiency in the art, would support efficient personnel tracking, monitoring, and/or personal emergency responses.

SUMMARY

In one aspect of the disclosure, people at different levels of an organization can carry personal emergency response system devices that communicate wirelessly with a server. Communications between the personal emergency system devices and the server can utilize dual-tone multi-frequency (DTMF) signals, Internet Protocol (IP) signals, or short message service (SMS) signals, to provide some representative examples without limitation. A website or web portal associated with the server can provide managers at different levels of the organization with information that is specific to the people they manage, as provided by the personal emergency response system devices.

The foregoing discussion of wireless tracking and personal emergency response system devices is for illustrative purposes only. Various aspects of the present disclosure may be more clearly understood and appreciated from a review of the following text and by reference to the associated drawings and the claims that follow. Other aspects, systems, methods, features, advantages, and objects of the present disclosure will become apparent to one with skill in the art upon examination of the following drawings and text. It is intended that all such aspects, systems, methods, features, advantages, and objects are to be included within this description and covered by this application and by the appended claims of the application.

Figure 1:
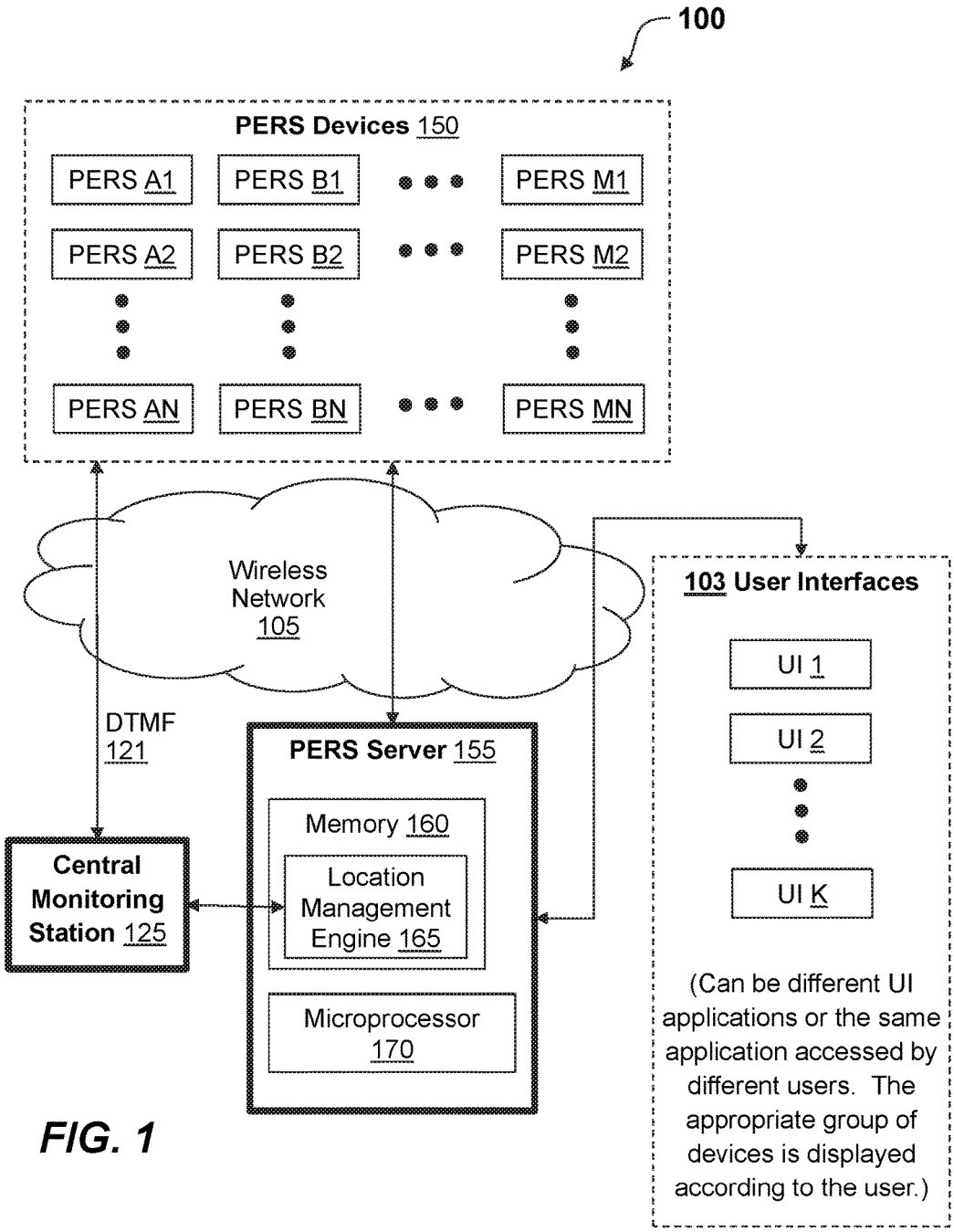
FIG. 1 is functional block diagram of a system for managing personal emergency response system devices in accordance with some example embodiments of the present disclosure.

Many aspects of the disclosure can be better understood with reference to the above drawings. The elements and features shown in the drawings are not necessarily to scale, emphasis being placed upon clearly illustrating the principles of exemplary embodiments of the present disclosure. Moreover, certain dimensions may be exaggerated to help visually convey such principles.

DESCRIPTION OF EXAMPLE EMBODIMENTS

Certain embodiments of the disclosure can improve operations of a computer-based system and process for tracking or determining location of personal emergency response system devices. Such improvements can comprise achieving more robust, reliable, or accurate tracking, for example.

Some example embodiments of the present disclosure will be discussed in further detail below with reference to the figures. However, the present technology can be embodied in many different forms and should not be construed as limited to the embodiments set forth herein. Rather, these embodiments are provided so that this disclosure will be thorough and complete, and will fully convey the scope of the disclosure to those having ordinary skill in the art. Furthermore, all "examples," "embodiments," "example embodiments," or "exemplary embodiments" given herein are intended to be non-limiting and among others supported by representations of the present technology.

Some of the embodiments may comprise or involve processes that will be discussed below. Certain steps in such processes may naturally need to precede others to achieve intended functionality or results. However, the technology is not limited to the order of the steps described to the extent that reordering or re-sequencing does not render the processes useless or nonsensical. Thus, it is recognized that some steps may be performed before or after other steps or in parallel with other steps without departing from the scope and spirit of this disclosure.

Turning now to FIG. 1, this figure illustrates a functional block diagram of an example system 100 for managing personal emergency response system devices 150 according to some embodiments of the present disclosure. As will be further discussed below, one or more user interfaces 103 can provide user-specific information that aids in managing groups of the personal emergency system response devices 150 and/or people carrying the devices 150.

In the example system 100 illustrated in FIG. 1, members of an organization carry personal emergency response system devices 150. Each person carrying a personal emergency response system device 150 can raise an emergency alert if the person experiences or encounters an emergency situation. For example, the personal emergency response system device 150 can transmit a wireless emergency alert if its carrier feels threatened, becomes injured, has an accident, observes someone having heart attack, or otherwise perceives an emergency event. In some embodiments, the personal emergency response system device 150 automatically senses an emergency event (for example by detecting a lack of motion or a heartbeat irregularity) or transmits the emergency alert based on an input (for example when its carrier presses a button or otherwise makes an entry).

In some example embodiments, the personal emergency response system device 150 comprises a purpose built cellular communication device. To mention a few representative examples without limitation, the personal emergency response system device 150 can comprise a pendant, wristband, cardiac monitor, fall monitor, or pocket-carried device that has an emergency button.

In some embodiments, the personal emergency response system device 150 can comprise a generic cellular telephone, such as a multipurpose smartphone. In such an embodiment, a personal emergency response application can be loaded onto the generic cellular telephone to support personal emergency response functionality. The personal emergency response application can display an icon or button on a graphical user interface that its carrier can touch or otherwise engage to raise an emergency alert, for example. In some example embodiments, the personal emergency response system device 150 comprises a global positioning system (GPS) sensor for locating the device 150. The personal emergency response system device 150 may alternatively utilize cellular tower triangulation or other appropriate location sensing technology, for example.

In the example system 100 illustrated in FIG. 1, there are an arbitrary number of personal emergency response system devices 150 that have an arbitrary number of groups and levels. As illustrated, the personal emergency system devices 150 are organized or grouped into "N" rows and "M" columns.

Column A comprises the personal emergency response system devices PERS A1, PERS A2, . . . , PERS AN; Column B comprises the personal emergency response system devices PERS B1, PERS B2, . . . , PERS BN; Column M comprises the personal emergency response system devices PERS M1, PERS M2, . . . , PERS MN; and so forth.

Row A comprises the personal emergency response system devices PERS A1, PERS B1, . . . , PERS M1; Row B comprises the personal emergency response system devices PERS A2, PERS B2, . . . , PERS M2; Row N comprises the personal emergency response system devices PERS AN, PERS BN, . . . , PERS MN; and so forth.

The different columns and rows of the personal emergency system response devices 150 can correspond to different groups and hierarchical levels within an organization, where each organization member carries a personal emergency response system device 150. For example, each manager in the organization may be responsible for the people in a column. Thus, manager A may be responsible for the people carrying the personal emergency system response devices 150 in column A (PERS A1, PERS A2, . . . , PERS AN); while manager B may be responsible for the people carrying the personal emergency system response devices 150 in column B (PERS B1, PERS B2, . . . , PERS BN); and manager M may be responsible for the people carrying the personal emergency system response devices 150 in column M (PERS M1, PERS M2, . . . , PERS MN); and so forth.

The organization may further include directors and vice presidents that are responsible for the respective groups of multiple managers. For example, a first vice president may be responsible for manager A, manager B, and manager C and their respective columns of people; a second vice president may be responsible for manager D, manager E, and manager F and their respective columns of people; and so forth.

The organization may further have a matrix management structure, where people may report to two or more different managers. Thus, the people may be organized into overlapping groups.

The system 100 illustrated in FIG. 1 comprises one or more user interfaces 103 that facilitate group and hierarchical management of the people in the organization based on the personal emergency response system devices 150. For example, each manager and vice president can carry a smartphone or computing device to monitor the people they are responsible for managing.

In some embodiments, each manager and vice president can remotely access a web interface or portal associated with the personal emergency response system server 155. Through that web interface or portal, the server 155 can provide each manager and vice president with information about their people, as provided by the personal emergency response system devices 150. In some embodiments, different levels of managers have different graphical user interfaces on their respective computing devices. In some embodiments, the different levels of managers utilize a common graphical user interface that is populated with information that is specific to their managerial duties. In some embodiments, the relationship could be between "elderly" and caregivers, wherein each caregiver is responsible for taking care of a group of elderly people.

In some embodiments, the user interfaces UI 1, UI 2, . . . , UI K illustrated in FIG. 1 represents multiple instances of one or more computer screens or webpages that present PERS data that is tailored to the user accessing the webpage, for example presenting information about selected groups of the personal emergency response system devices 150. Such webpages may run on different hardware or computing platforms, for example. In some embodiments, the user interfaces UI 1, UI 2, . . . , UI K illustrated in FIG. 1 represents different, user-specific webpages that represent example embodiments of a web portal.

More particularly, as illustrated in FIG. 1, user interfaces 103 for the various managers, directors, and vice presidents of the organization can be represented by UI 1, UI, 2, . . . , UI K, without limitation. Thus, each of the user interfaces UI 1, UI, 2, . . . , UI K can be an instance of a common webpage populated with user-specific data about the relevant personal emergency response system devices 150.

In the illustrated embodiment, the system 100 comprises a wireless network 105. The wireless network 100 can comprise a cellular system that uses cellular towers to support long-range communication, for example. In some embodiments, the wireless network 105 comprises one or more cellular systems networked with a packet-switched network such as the Internet or a private network that operates using Internet Protocol.

As illustrated, the personal emergency response system devices 150 communicate with the personal emergency response system server 155 over the wireless network 105 and further communicate with a central monitoring station 125 over the wireless network 105. In some embodiments, the personal emergency response system devices 150 communicate with the central monitoring station 125 and the personal emergency response system server 155 over different wireless networks 105.

In some example embodiments, the personal emergency response system devices 150 communicate with the central monitoring station 125 utilizing dual-tone multi-frequency (DTMF) signals. In some example embodiments, the personal emergency response system devices 150 communicate with the central monitoring station 125 utilizing Internet Protocol (IP) signals. In some example embodiments, the personal emergency response system devices 150 communicate with the central monitoring station 125 utilizing short message service (SMS) signals.

As illustrated, the personal emergency response system device server 155 can respond to communications received from the personal emergency response system device 150, including emergency alerts, for example. The personal emergency response system device server 155 can comprise a gateway or middleware server. The personal emergency system device server 155 can comprise communication interfaces for communication with the personal emergency response system devices 150, the central monitoring station 125, and one or more user interfaces 103.

In some example embodiments, the personal emergency response system server 155 can communicate with the central monitoring station 125 over the wireless network 105. In an example embodiment, the central monitoring station 125 can comprise agents for responding when a carrier of a personal emergency response system device 150 raises an alarm. For example, when the personal emergency response system server 155 receives an emergency alert, the server 155 can forward the alert to the central monitoring station 125 to respond or take appropriate action. A human agent at the central monitoring station 125 may open a two-way voice channel to the personal emergency response system device 150 and make a decision about calling and deploying police, ambulance, or other emergency personnel, for example.

In an example embodiment, the personal emergency response system server 155 provides location services for the personal emergency response system device 150 as well as for other wireless tracking devices (not illustrated) that may be attached to people, animals, or objects. In some embodiments, the personal emergency response system device server 155 may store configuration data that may be downloaded to personal emergency response system devices 150, such as during startup or rebooting, and/or application programs downloaded to generic cellular telephones as discussed above.

In some example embodiments, the personal emergency response system server 155 can comprise a group or cluster of servers acting as a single logical entity. In some embodiments, the central monitoring station 125 comprises the personal emergency response system server 155. In some embodiments, the personal emergency response system server 155 and the central monitoring station 125 are collocated but are separate systems that may be networked or linked together. The personal emergency response system server 155 and the central monitoring station 125 can be remote from one another in some embodiments, and may be managed by different business entities.

In the illustrated example form, the personal emergency response system server 155 comprises a microprocessor 170, memory 160, and a location management engine 165 stored in the memory 160 and executed by the microprocessor 170.

Example embodiments of the memory 160 can comprise volatile and nonvolatile memory, such as random access memory (RAM) and flash memory for example. In an example embodiment, the memory 160 can comprise firmware for executing management and control functions. For example, the memory 160 can comprise persistent memory that stores program code, including the location management engine 165. An example embodiment of the location management engine 165 can comprise computer executable instructions for implementing process 400 that is illustrated in flowchart form in FIG. 4 and discussed below.

Figure 2:
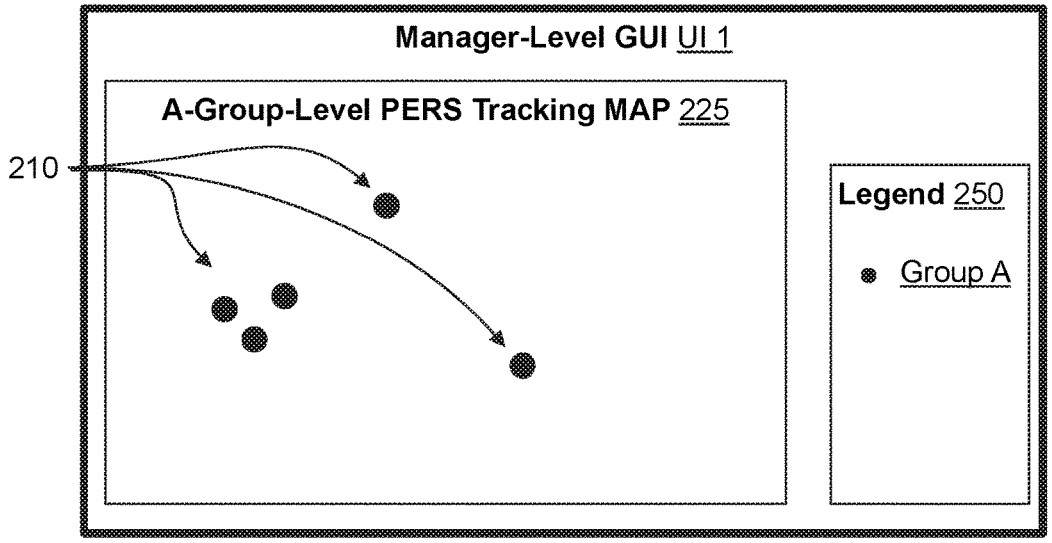
FIG. 2 is an illustration of a manager-level graphical user interface for managing personal emergency response system devices in accordance with some example embodiments of the present disclosure.
Figure 3:
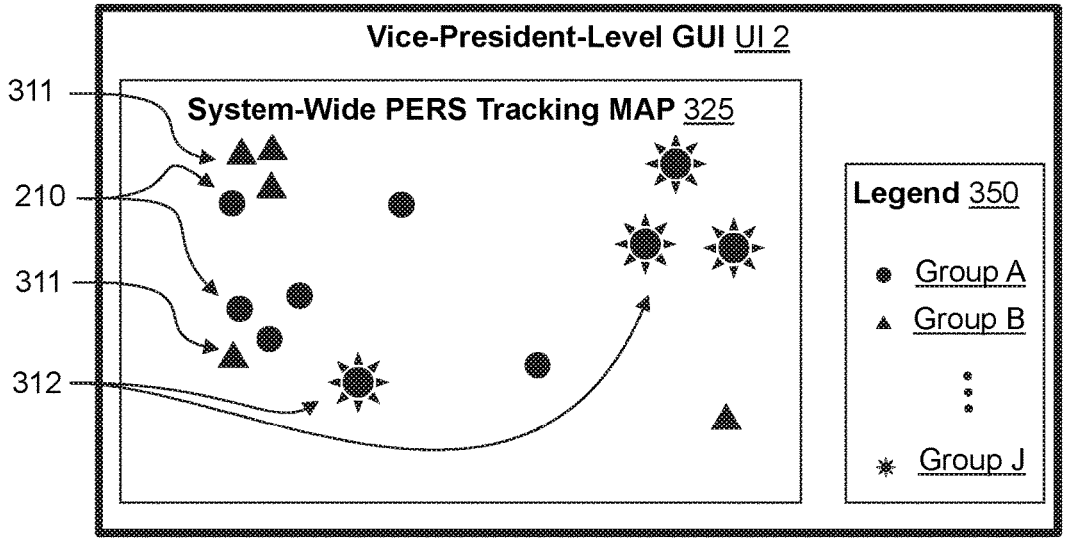
FIG. 3 is an illustration of a vice-president-level graphical user interface for managing personal emergency response system devices in accordance with some example embodiments of the present disclosure.

Turning now to FIGS. 2 and 3, these figures illustrate example graphical user interfaces UI 1, UI 2 for managing personal emergency response system devices 150 according to some embodiments of the present disclosure. FIG. 2 illustrates an example manager-level graphical user interface UI 1, and FIG. 3 illustrates an example vice-president-level graphical user interface UI 2. As discussed above, the two graphical user interfaces UI 1, UI 2 can be two instances of a webpage that may be displayed on different computing screens and that comprise maps 225, 325 populated with different information. The maps 225, 325 graphically depict geographic positions or coordinates of the personal emergency response system devices 150 in the respective groups 210, 311, 312 based on signals sent from the personal emergency response system devices 150 to the PERS server 155.

The graphical user interface UI 1 illustrated in FIG. 2 comprises a map 225 that tracks a group 210 of personal emergency response system devices 150, as indicated in the legend 250. The group 210 might be a particular column in the PERS matrix illustrated in FIG. 1. That is, the PERS group 210 might be made up of the personal emergency response system devices PERS A1, PERS A2, . . . , PERS AN illustrated in FIG. 1.

Meanwhile, the graphical user interface UI 2 illustrated in FIG. 3 comprises a map 325 that tracks multiple groups 210, 311, 312 of personal emergency response system devices 150, as indicated in the legend 350. The groups 210, 311, 312 might be multiple columns in the PERS matrix illustrated in FIG. 1. That is, the PERS groups 210, 311, 312 might be made up of the personal emergency response system devices PERS A1, PERS A2, . . . , PERS AN; the personal emergency response system devices PERS B1, PERS B2, . . . , PERS BN; and the personal emergency response system devices PERS C1, PERS C2, . . . , PERS CN (as illustrated in FIG. 1).

As illustrated, the graphical user interface UI 2 is at least one hierarchical level above the graphical user interface UI 1. Accordingly, the graphical user interface UI 2 of FIG. 3 presents locational information for the personal emergency response system devices 150 presented on the graphical user interface UI 1 of FIG. 2 plus additional personal emergency response system devices 150. Thus, the graphical user interface UI 1 of FIG. 2 can provide manager-level PERS data, while the graphical user interface UI 2 of FIG. 3 can provide vice-president-level PERS data.

In some other embodiments, as an alternative to a map view or in addition to a map view (as illustrated in FIGS. 2 and 3), information may be displayed in a dashboard or tabular format. In such a format, displayed information may include device ID, user and alert details, and/or location, for example.

Figure 4:
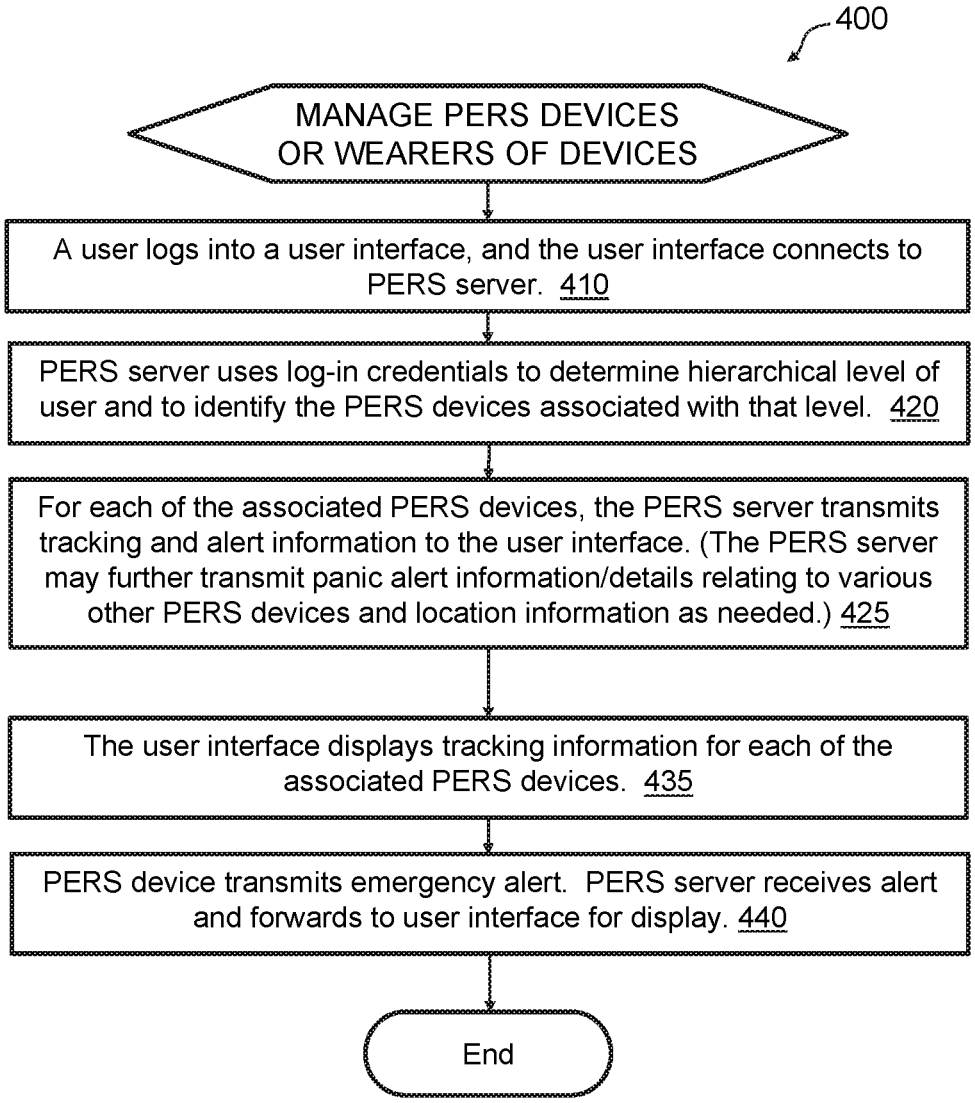
FIG. 4 is flowchart of a process for managing personal emergency response system devices in accordance with some example embodiments of the present disclosure.

Turning now to FIG. 4, this figure illustrates a flowchart of an example process 400 for managing personal emergency response system devices 150 according to some embodiments of the present disclosure. Process 400 can comprise an example embodiment of the location management engine 165 that is illustrated in FIG. 1, for example.

In some example embodiments, instructions for execution of the relevant steps of process 400 can be stored in the memory 160 and executed by the microprocessor 170 of the personal emergency response system server 155. For example, process 400 can be practiced using instructions that are provided in the location management engine 165 or in some other appropriate location or locations. Recognizing that the process 400 can be implemented or practiced in various places, the process 400 will be discussed below with reference to an embodiment in which instructions are stored in the personal emergency response system server 155, without limitation. As discussed above, the personal emergency response system server 155 can comprise a gateway or middleware server.

At block 410 of process 400, a user logs into a user interface 103. The user interface 103 establishes a remote connection to the personal emergency response system server 155. The connection can be over the wireless network 105, over the Internet, over another appropriate network, or over a combination of appropriate networks, for example.

At block 420 of process 400, the personal emergency response system server 155 applies the user's login credentials to determine the user's hierarchical level within the organization. The personal emergency response system server 155 further identifies the personal emergency response system devices 150 associated with the user's hierarchical level.

At block 425 of process 400, the personal emergency response system server 155 transmits to the user interface 103 tracking information for the personal emergency response system devices 150 identified at block 420 as associated with the logged-in user. The personal emergency response system server 155 may further transmit panic alert information and details relating to various other personal emergency system devices 150 and location information as needed or appropriate.

At block 435, the user interface 103 displays tracking information for each of the personal emergency system devices 150 associated with the logged-in user. Accordingly, the user interface 103 can generate a screen as illustrated in FIG. 2 or 3 in accordance with the user's hierarchal level within the organization.

At block 440, one of the personal emergency response system devices 150 issues an emergency alert, which is received at the personal emergency response system server 155. The emergency alert can be transmitted using dual-tone multi-frequency (DTMF) signals, Internet Protocol (IP) signals, or short message service (SMS) signals, for example. The personal emergency response system server 155 sends a message to the user interface 103 about the alert, including for example an identification of the personal emergency response system device 150 that issued the alert. The user interface 103 receives the message and displays the alert and an identification of the device 150 for viewing by the user.

Following execution of block 440, process 400 ends. In some example embodiments, process 400 iterates repetitively, in whole or part, to manage personal emergency response system devices 155 as discussed above.

Technology for location determination and emergency response that is useful in managing organizations of people and other environments and applications has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art.

What is claimed is:

1. A system comprising:

one or more communication interfaces collectively configured to:

receive emergency alerts transmitted wirelessly from each personal emergency response (PERS) device in a system of PERS devices;

communicate with one or more central monitoring stations; and communicate with a plurality of users;

memory;

a processor that is operably coupled to the communication interface and to the memory; and processor executable instructions stored in the memory for performing the steps of:

responsive to receiving a first input from a first user in the plurality of users, determine a first hierarchical level associated with the first user;

identify a first subset of PERS devices in the system of PERS devices according to the first hierarchical level;

transmit to the first user tracking information for each PERS device in the first subset of PERS devices;

responsive to receiving a second input from a second user in the plurality of users, determine a second hierarchical level associated with the second user, wherein the second hierarchical level is above the first hierarchal level;

identify a second subset of PERS devices in the system of PERS devices according to the second hierarchical level, wherein the second subset of PERS devices comprises the first subset of PERS devices and additional PERS devices in the system of PERS devices;

transmit to the second user tracking information for each PERS device in the second subset of PERS devices;

receive an emergency alert that originated at one PERS device in the system of PERS devices with an associated dual-tone multi-frequency (DTMF) signal; and send a message about the emergency alert to a user that is associated with the one PERS device, the message comprising an identification of the one PERS device that was made based on the associated DTMF signal.

2. The system of claim 1, wherein the first user and the second user are logged in to a web portal that provides user-specific information according to the first hierarchical level and the second hierarchical level.

3. The system of claim 1, wherein the first user and the second user are logged in to a web portal that provides user-specific information according to the first subset of PERS devices and the second subset of PERS devices.

4. The system of claim 1, wherein a first user interface is associated with the first user, wherein a second user interface is associated with the second user, and wherein the first user interface and the second use interface have a common graphical layout for presenting user-specific tracking and alert information.

5. The system of claim 1, wherein a first graphical user interface is assigned to the first user for presenting tracking information about the first subset of PERS devices, and wherein a second graphical user interface is assigned to the second user for presenting tracking information about the second subset of PERS devices.

6. The system of claim 1, wherein the PERS devices are purpose built, and wherein the user comprises the first user or the second user.

7. The system of claim 1, wherein the PERS devices comprise generic cellular telephones loaded with a PERS application.

8. A system comprising:

one or more communication interfaces collectively configured to:

receive emergency alerts transmitted wirelessly from each personal emergency response (PERS) device in a system of PERS devices;

communicate with one or more central monitoring stations; and communicate with a plurality of users;

memory;

a processor that is operably coupled to the communication interface and to the memory; and processor executable instructions stored in the memory for performing the steps of:

responsive to receiving a first input from a first user in the plurality of users, determine a first hierarchical level associated with the first user;

identify a first subset of PERS devices in the system of PERS devices according to the first hierarchical level;

transmit to the first user tracking information for each PERS device in the first subset of PERS devices;

responsive to receiving a second input from a second user in the plurality of users, determine a second hierarchical level associated with the second user, wherein the second hierarchical level is above the first hierarchal level;

identify a second subset of PERS devices in the system of PERS devices according to the second hierarchical level, wherein the second subset of PERS devices comprises the first subset of PERS devices and additional PERS devices in the system of PERS devices;

transmit to the second user tracking information for each PERS device in the second subset of PERS devices;

receive an emergency alert that originated at one PERS device in the system of PERS devices with an associated Internet Protocol (IP) signal; and send a message about the emergency alert to a user associated with the one PERS device, the message comprising an identification of the one PERS device that was made based on the associated IP signal.

9. The system of claim 8, wherein the first user and the second user are logged in to a web portal that provides user-specific information according to the first hierarchical level and the second hierarchical level.

10. The system of claim 8, wherein the first user and the second user are logged in to a web portal that provides user-specific information according to the first subset of PERS devices and the second subset of PERS devices.

11. The system of claim 8, wherein a first user interface is associated with the first user, wherein a second user interface is associated with the second user, and wherein the first user interface and the second use interface have a common graphical layout for presenting user-specific tracking and alert information.

12. The system of claim 8, wherein a first graphical user interface is assigned to the first user for presenting tracking information about the first subset of PERS devices, and wherein a second graphical user interface is assigned to the second user for presenting tracking information about the second subset of PERS devices.

13. The system of claim 8, wherein the PERS devices are purpose built, and wherein the user comprises the first user or the second user.

14. The system of claim 8, wherein the PERS devices comprise generic cellular telephones loaded with a PERS application.

15. A system comprising:

one or more communication interfaces collectively configured to:

receive emergency alerts transmitted wirelessly from each personal emergency response (PERS) device in a system of PERS devices;

communicate with one or more central monitoring stations; and communicate with a plurality of users;

memory;

a processor that is operably coupled to the communication interface and to the memory; and processor executable instructions stored in the memory for performing the steps of:

responsive to receiving a first input from a first user in the plurality of users, determine a first hierarchical level associated with the first user;

identify a first subset of PERS devices in the system of PERS devices according to the first hierarchical level;

transmit to the first user tracking information for each PERS device in the first subset of PERS devices;

responsive to receiving a second input from a second user in the plurality of users, determine a second hierarchical level associated with the second user, wherein the second hierarchical level is above the first hierarchal level;

identify a second subset of PERS devices in the system of PERS devices according to the second hierarchical level, wherein the second subset of PERS devices comprises the first subset of PERS devices and additional PERS devices in the system of PERS devices;

transmit to the second user tracking information for each PERS device in the second subset of PERS devices;

receive an emergency alert that originated at one PERS device in the system of PERS devices with an associated short message service (SMS) signal; and send a message about the emergency alert to a user associated with the one PERS device, the message comprising an identification of the one PERS device that was made based on the associated SMS signal.

16. The system of claim 15, wherein the first user and the second user are logged in to a web portal that provides user-specific information according to the first hierarchical level and the second hierarchical level.

17. The system of claim 15, wherein the first user and the second user are logged in to a web portal that provides user-specific information according to the first subset of PERS devices and the second subset of PERS devices.

18. The system of claim 15, wherein a first user interface is associated with the first user, wherein a second user interface is associated with the second user, and wherein the first user interface and the second use interface have a common graphical layout for presenting user-specific tracking and alert information.

19. The system of claim 15, wherein a first graphical user interface is assigned to the first user for presenting tracking information about the first subset of PERS devices, and wherein a second graphical user interface is assigned to the second user for presenting tracking information about the second subset of PERS devices.

20. The system of claim 15, wherein the PERS devices are purpose built or comprise generic cellular telephones loaded with a PERS application, and wherein the user comprises the first user or the second user.

21. A system comprising:

one or more communication interfaces collectively configured to:

receive emergency alerts transmitted wirelessly from each personal emergency response (PERS) device in a system of PERS devices;

communicate with one or more central monitoring stations; and communicate with a plurality of users;

memory;

a processor that is operably coupled to the communication interface and to the memory; and processor executable instructions stored in the memory for performing the steps of:

responsive to receiving a first input from a first user in the plurality of users, identify a first subset of PERS devices in the system of PERS devices that are associated with the first user;

transmit to the first user tracking information for each PERS device in the first subset of PERS devices;

responsive to receiving a second input from a second user in the plurality of users, identify a second subset of PERS devices in the system of PERS devices that are associated with the second user;

transmit to the second user tracking information for each PERS device in the second subset of PERS devices;

receive an emergency alert that originated at a particular PERS device in the system of PERS devices with an associated signal that comprises a dual-tone multi-frequency (DTMF) signal, an Internet Protocol (IP) signal, or a short message service (SMS) signal; and send a message about the emergency alert to one or more users associated with the particular PERS device, the message comprising an identification of the particular PERS device that was made based on the associated signal.

22. The system of claim 21, wherein the first subset of PERS devices comprises the particular PERS device and wherein the one or more users comprises the first user.

23. The system of claim 21, wherein the second subset of PERS devices comprises the particular PERS device.

24. The system of claim 21, wherein the first subset of PERS devices and the second subset of PERS devices are mutually exclusive.

25. The system of claim 21, wherein the first subset of PERS devices and the second subset of PERS devices overlap.

26. The system of claim 21, wherein the first subset of PERS devices comprises the second subset of PERS devices.

27. The system of claim 21, wherein the associated signal comprises the dual-tone multi-frequency (DTMF) signal.

28. The system of claim 21, wherein the associated signal comprises the Internet Protocol (IP) signal.

29. The system of claim 21, wherein the associated signal comprises the short message service (SMS) signal.

* * * * *